US005261345A

United States Patent [19]

Fleming

[11] Patent Number: 5,261,345

[45] Date of Patent: Nov. 16, 1993

[54] INFLATABLE PNEUMATIC BOAT WITH A NON-FLAT REAR BOARD

[75] Inventor: Timothy Fleming, Puteaux, France

[73] Assignee: Zodiac International, Issy les Moulineaux, France

[21] Appl. No.: 858,300

[22] Filed: Mar. 26, 1992

[30] Foreign Application Priority Data

Mar. 26, 1991 [FR] France ..... 91 03640

[51] Int. Cl.[5] ..... B63B 7/00

[52] U.S. Cl. ..... 114/345; 114/355; 114/61

[58] Field of Search ..... 114/355-358, 114/56, 65 R, 343, 82, 345, 292, 362, 363, 61, 270; 441/40; 440/49, 900

[56] References Cited

U.S. PATENT DOCUMENTS

| | | | |
|---|---|---|---|
| 2,376,753 | 5/1945 | Bowen | 114/357 |
| 2,969,551 | 1/1961 | Snider | 114/355 |
| 3,608,112 | 9/1971 | Irgens | 114/345 |
| 3,877,095 | 4/1975 | Ivy | 114/355 |
| 4,713,028 | 12/1987 | Duff | 440/61 |
| 4,742,795 | 5/1988 | DePrey | 114/362 |
| 4,811,682 | 3/1989 | Hwang | 114/345 |
| 4,895,095 | 1/1990 | Potter | 114/357 |
| 4,945,852 | 8/1990 | Kobayashi | 114/363 |
| 5,131,348 | 7/1992 | Roy | 114/345 |

FOREIGN PATENT DOCUMENTS

| | | |
|---|---|---|
| 0274359 | 7/1988 | European Pat. Off. . |
| 1592856 | 6/1970 | France . |
| 2070272 | 9/1971 | France . |
| 2073923 | 10/1971 | France . |
| 1277480 | 6/1972 | United Kingdom . |
| 2001586 | 2/1979 | United Kingdom . |

*Primary Examiner*—Robert J. Oberleitner
*Assistant Examiner*—Clifford T. Bartz
*Attorney, Agent, or Firm*—Larson and Taylor

[57] ABSTRACT

An inflatable pneumatic boat with a non-flat rear board.

An inflatable pneumatic boat comprising a rear board (5) extending transversely and approximately vertically between two lateral floats (2), characterized in that the rear board (5) is a non-flat one-piece component and has two lateral panels (6), each connected to a float (2), and a central panel (7) offset to the rear beyond the rear edge of the bottom (4) of the boat.

13 Claims, 2 Drawing Sheets

INFLATABLE PNEUMATIC BOAT WITH A NON-FLAT REAR BOARD

BACKGROUND OF THE INVENTION

The invention relates to improvements to inflatable pneumatic boats comprising a rear board extending transversely and approximately vertically between two lateral floats.

In pneumatic boats of this kind, the rear board is simply a substantially flat board which extends between the two floats and is connected thereto in sealing-tight manner. The purpose of the rear board is to close the back of the boat and also to carry the outboard motor. It must therefore be sufficiently strong to withstand both the weight of the engine and the shocks transmitted by the engine during navigation on choppy water. From the point of view of mechanical strength alone, the flat shape normally adopted for the rear board is not the most suitable.

Also, the rear board overhangs the rear end of the bottom of the boat, and the propeller, which is carried by the engine secured to the rear board, rotates in a region where the water flow is particularly disturbed. This reduces its efficiency. Attempts have already been made to obviate this disadvantage by shifting the engine and propeller beyond the rear board so that the propeller can rotate in a region where the water flow is less disturbed. In that case, however, bulky accessories have to be positioned on the rear board and are expensive and increase the weight of the boat.

With regard to other considerations, some "composite-hull" inflatable boats have a rigid bottom surrounded by the inflatable float and a rigid deck structure attached to the rigid bottom and secured thereto along their common periphery. In this kind of boat, the rigid bottom and the rigid deck structure are both constructed with a rear panel extending approximately vertically upwards. When the bridge structure is fitted on the bottom, the vertical panel secured to the bottom faces the vertical panel secured to the bridge structure so as to form the rear board when connected. However, the bottom and the deck structure are assembled by sticking, and it is a difficult, lengthy process to position the two components and stick them correctly, since their shape is so complex. Also, the resulting rear board has insufficient mechanical strength and has to be reinforced. A plywood board, having substantially the same dimensions as the two panels joined to form the rear board, is inserted between the two panels. The wooden board is heavy and further increases the cost of the boat.

The main aim of the invention, as far as possible, is to obviate the various disadvantages of rear boards on conventional inflatable boats and to provide an improved rear board which is better at meeting the various practical requirements with regard to all the points previously mentioned and others also.

SUMMARY OF THE INVENTION

To this end, an inflatable pneumatic boat comprising a rear board extending transversely and approximately vertically between two side floats is mainly characterised, when designed according to the invention, in that the rear board is a non-flat one-piece component and has two lateral panels, each connected to a float, and a central panel offset to the rear beyond the rear edge of the bottom of the boat.

DESCRIPTION OF PREFERRED EMBODIMENTS

Figure 1:
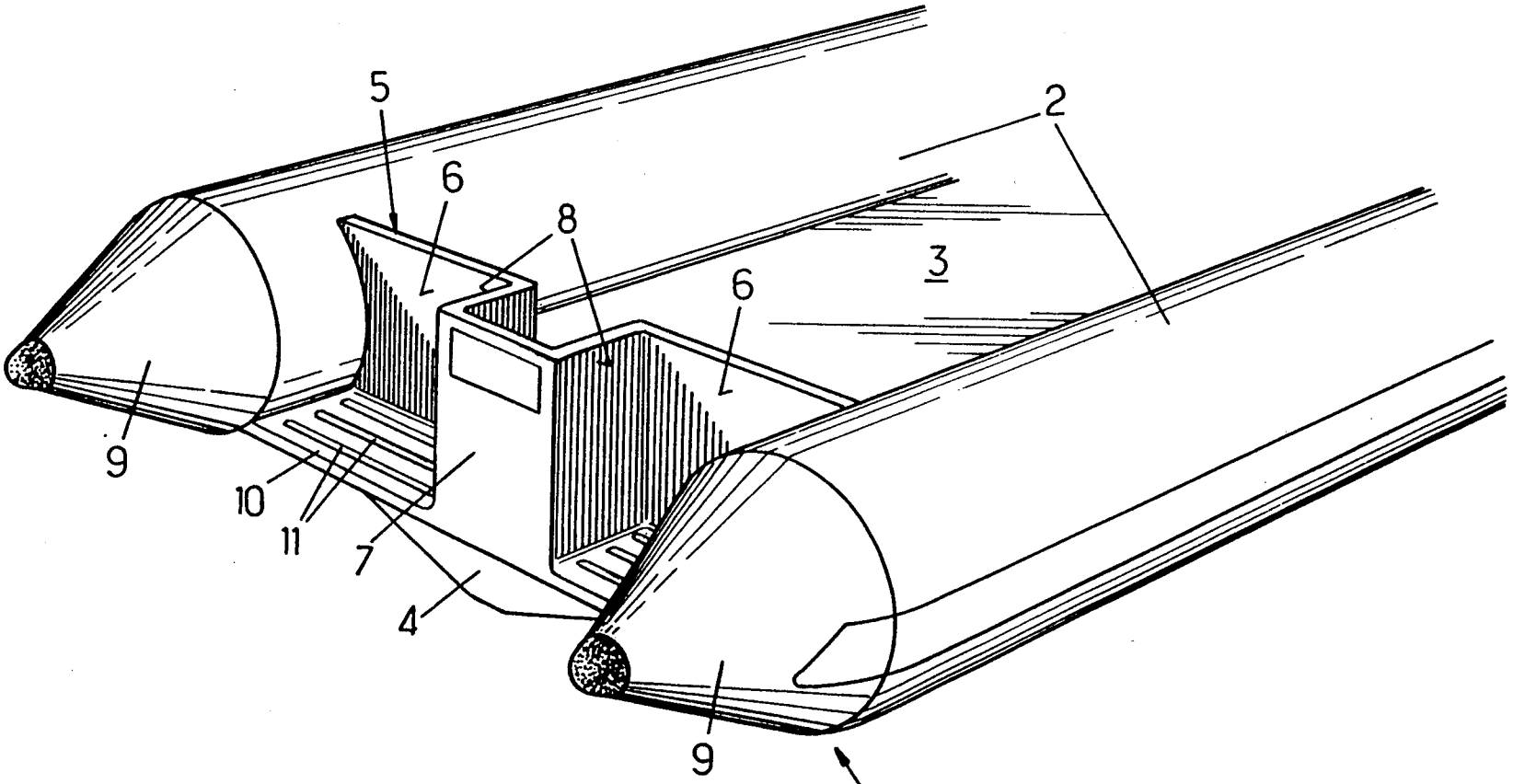

Accordingly the rear board designed as per the invention, without addition of components or modifications of any kind, can provide the advantages inherent in positioning the propeller where the water flow is less disturbed than at the side panels, the place where the propeller has normally been disposed hitherto. Advantageously also, from this point of view, the central panel is offset to the rear until it is approximately level with the tapering conical rear portion of the floats, since this portion is normally outside the water and does not contribute to the disturbance of the water flow.

Also, the rear board according to the invention, at its two lateral ends, is shaped in the same manner as a conventional flat rear board. It can therefore be joined to the two lateral floats in the manner conventionally adopted for flat boards. Also, the propeller is advantageously offset to the rear by rearwardly offsetting only the central panel of the board, with the result that the two surrounding side panels can remain in the position conventionally occupied by flat boards. A board according to the invention therefore can be fitted without any modification in the position of the means on the floats for securing the board to the floats.

Also, since the central panel is offset relative to the two side panels, the board has a relatively complex shape (e.g. the shape of a square wave as seen from above) which gives it higher intrinsic mechanical strength than a flat board. Consequently, depending on the transverse dimension of the boat and the maximum weight of the motor for mounting on the board, the board can be without a mechanical reinforcement, or the reinforcement will be needed only for the central panel, and can be in the form e.g. of an inserted wooden board, which in any case will be smaller than the inserts in prior-art flat boards. The result is an improvement in weight and reduction in cost.

Advantageously the two lateral panels have substantially horizontal surfaces forming steps, preferably extending towards the rear and substantially as far as the central panel and also preferably situated approximately at the base of the side panels. The resulting inflatable boats can be entered from the water by swimmers, a facility which hitherto has been restricted to rigid-hull boats. In addition the surfaces, which are positioned in each recess bounded by the lateral panel of the board and the side connecting the central panel to the lateral panel, are mechanically secured to the respective lateral panels and the respective sides adjacent the central panel, and therefore increase the rigidity of the rear board, which is therefore much stronger than an ordinary flat board.

In a simple embodiment, the central panel is substantially parallel to the lateral panels and is connected thereto by two connecting sides substantially parallel to one another and substantially perpendicular to the central and lateral panels. The board, as seen from above, has approximately the shape of a square wave.

In particular, in the case where the rear board is equipped with surfaces forming steps, the central panel and the two lateral panels can each extend over approximately a third of the length of the rear board.

The rear board designed according to the invention is of use in all kinds of inflatable boats, but particularly useful in the case of a composite-hull inflatable boat comprising a rigid body surrounded by inflatable floats and with a rigid deck structure covering the rigid bottom and mechanically secured thereto. In this case, the rear board designed according to the invention can be made an integral part either of the rigid bottom or of the rigid deck structure, from the rear of which it can project approximately vertically upwards. It is then easier to manufacture the components of the boat, since only the bottom or only the deck structure will be formed with the rear projection constituting the board, whereas the other structure (i.e. the deck or bottom) can be given a much simpler shape without rear projections. This avoids the disadvantages of the prior art boats, in which both the bottom and the bridge structure have a rear projection, which complicates manufacture of these two components and particularly complicates the process of fitting and sticking the bottom to the deck structure, particularly as regards joining the two projections for forming the complete rear board.

The features of the invention can considerably simplify the process of assembly, inter alia by sticking the bottom to the deck structure, since the respective edges for sticking the bottom to the deck structure can now be made to extend approximately in one plane. To obtain a rigid join over the entire periphery, including along the rear edge, the component (bottom or deck structure) equipped with the rear board can be provided with a flange which extends along the board and forms a supporting shoulder on which the corresponding edge of the other component can be mounted (e.g. by sticking).

Figure 2:
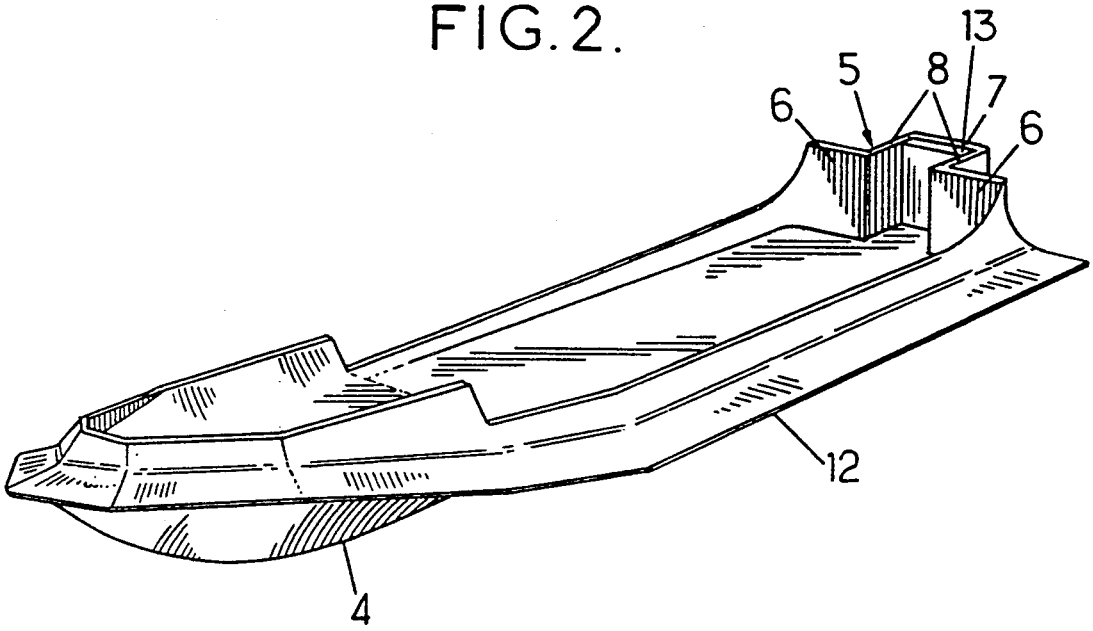

The invention will be more clearly understood from the following detailed description of a preferred embodiment given by way of non-limitative example only. In the description, reference is made to the accompanying drawings in which:

FIG. 1 is a perspective three-quarter rear view of the rear part of an inflatable boat equipped with a rear board according to the invention, and FIG. 2 is a perspective three-quarter front view, of a rigid bottom of use in constructing an embodiment of the boat in FIG. 1.

Referring firstly to FIG. 1, the rear part of an inflatable pneumatic boat (general reference 1) comprises two lateral floats 2 extending on either side of a floor 3 underneath which a bottom 4 extends. Towards the rear, the boat is closed by a rear board 5 which extends between the two floats 2 and is suitably secured in sealing-tight manner thereto.

The rear board 5 is in the form of a non-flat one-piece component with two side panels 6 connected to the two respective floats 2 and disposed one on each side of a central panel offset to the rear relative to the lateral panels 6 such that the rear board, when viewed from above with the boat afloat, has a U-shaped central section, the central panel forming the bottom of the U-shaped central section and the side panels forming the sides of the U-shaped central section. Side walls 8 join the central panel to the lateral panels. In the example shown, the central panel 7 is substantially parallel to the side panels 6 and the side walls 8 are substantially parallel to one another and substantially perpendicular to the central and side panels so that, seen from above, the board 5 has approximately the shape of a square wave.

In the example shown, the central and side panels each occupy about one-third of the length of the board, but other layouts are possible.

The central panel 7 is offset to the rear beyond the rear edge of the body 4, and is preferably level with the substantially conical, tapering rear portion 9 of the lateral floats 2, which extend above the surface of the water when the boat is in the normal floating position.

If required, inter alia if a large heavy motor has to be secured to the central panel of the rear board, the central panel can be mechanically strengthened e.g. by an insert such as plywood board insert 13 shown in FIG. 2.

In addition, the lateral panels 6 can have substantially horizontal surfaces 10 forming steps. The surfaces 10 are situated approximately at the base of the lateral panels 6 and extend to the rear and as far as the central panel 7. The steps 10 are given an anti-skid cover or have anti-skid projections 11.

The rear board 5 can be an individual component which is assembled and fitted in the boat in the same manner as a conventional flat board. It can readily take the place of a flat board already installed in an existing boat.

However, the rear board 5 is particularly advantageous in composite-hull inflatable boats, in which the hull comprises a rigid bottom 4 with an inflatable float 2 around its periphery 12 and covered by a rigid deck structure 3, the bottom 4 and the deck structure 3 usually being mechanically joined by sticking along their edges.

The complete rear board 5 can form an integral part either of the rigid deck structure 3 or the rigid bottom 4, from the rear of which it projects upwards. FIG. 2 is a perspective view of a rigid bottom 4 (not encased), equipped and integral with a rear vertical projection constituting the complete rear board 5. Under these conditions, the rigid deck structure and the rigid bottom are fitted together along contours which are approximately flat and simplify the relative positioning of the two components when joined, inter alia by sticking.

Of course as is clear from the foregoing, the invention is in no way limited to those applications and embodiments considered in detail, but includes all variants.

I claim:

1. In an inflatable pneumatic boat intended to be propelled by an outboard motor, said boat comprising two lateral floats and being provided with a rear board adapted to support an outboard motor, said rear board extending transversely between said two lateral floats, the improvement wherein said rear board comprises a non-flat one-piece component comprising: a central panel adapted to support an outboard motor; two lateral panels located, respectively, on opposite sides of said central panel and each being connected, respectively, to one of said lateral floats; and two side panels connecting said two lateral panels to said central panel; said one-piece non-flat rear board, when viewed from above with the boat afloat, having a U-shaped central section, said central panel being offset to the rear of the boat relative to said lateral panels and forming the bottom of said U-shaped central section, and side panels forming the sides of said U-shaped central section.

2. A boat according to claim 1 wherein said rear board further comprises two lateral panels which are located respectively on opposite sides of said central panel, said two lateral panels being connected, respectively, to said floats.

3. A boat according to claim 1 wherein the rear portion of each of said floats is tapered, the rear tapered portions of the floats being above the water surface when the boat is in its normal floating position, wherein each of said lateral panels is connected to said float at a point forward of the rear tapered portion of the float and wherein said central panel of said rear board is offset to the rear of said boat such that it is approximately in alignment with the rear tapered portions of said floats.

4. A boat according to claim 1 wherein said central panel of said rear board comprises mechanical reinforcement means.

5. A boat according to claim 1, further comprising substantially horizontal step surfaces, each of said step surfaces extending rearwardly from one of said two lateral panels.

6. A boat according to claim 5 wherein said steps extend rearwardly substantially as far as said central panel.

7. A boat according to claim 5 wherein said step surfaces are located approximately at the base of said lateral panels.

8. A boat according to claim 1 wherein said rear board is oriented substantially vertically.

9. A boat according to claim 1 wherein said central panel is substantially parallel to said lateral panels and wherein said connecting sides are substantially parallel to one another and are substantially perpendicular to said central panel and said side panels, whereby said rear board, when viewed from above with the boat afloat, has approximately the shape of a square wave.

10. A boat according to claim 1 wherein said central panel and said two lateral panels each extend over approximately one-third of the length of the rear board.

11. A boat according to claim 1, further comprising a rigid bottom surrounded by said inflatable floats, and rigid deck structure covering the rigid bottom, said rear board being an integral part of the rigid deck structure, said rear board projecting approximately vertically upwards from the rear of said deck structure.

12. A boat according to claim 11 wherein said rigid deck structure and said rigid bottom have substantially flat respective contours adapted to fit together.

13. A boat according to claim 1 wherein said central panel is offset to the rear beyond the rear edge of the bottom of said boat.

* * * * *